US005784265A

United States Patent [19]

Chen

[11] Patent Number: 5,784,265

[45] Date of Patent: Jul. 21, 1998

[54] ILLUMINATING COASTER

[76] Inventor: Ken-Wang Chen, P.O. Box 82-144, Taipei, Taiwan

[21] Appl. No.: 858,396

[22] Filed: May 19, 1997

[51] Int. Cl.[6] ..... F21V 33/00

[52] U.S. Cl. ..... 362/101; 362/154; 362/800; 362/802

[58] Field of Search ..... 362/101, 154, 362/234, 253, 800, 806, 802

[56] References Cited

U.S. PATENT DOCUMENTS

| | | | |
|---|---|---|---|
| 4,261,026 | 4/1981 | Bolha | 362/101 |
| 4,336,574 | 6/1982 | Goodman | 362/101 |
| 4,858,084 | 8/1989 | Sheryll | 362/101 |
| 5,010,461 | 4/1991 | Saotome | 362/101 |
| 5,307,250 | 4/1994 | Pearson | 362/101 |

*Primary Examiner*—Stephen F. Husar
*Attorney, Agent, or Firm*—A & J

[57] ABSTRACT

An illuminating coaster includes an upper member, an intermediate member, a lower member, an illuminating assembly arranged between the upper member and the intermediate member and including a first conducting member, a second conducting member, and batteries, the first conducting member being fixedly mounted on an inner side of the upper member, the first conducting member being fixedly mounted on an inner side of the upper member, the second conducting member being provided with a light-emitting diode, the batteries being disposed between the first and second conducting members, whereby when a glass is put onto the coaster, the upper member will be pressed downwardly to make the first conducting member contact the batteries thereby forming a closed circuit and therefore causing the light-emitting diode to give light through a bottom of the glass.

2 Claims, 3 Drawing Sheets

ILLUMINATING COASTER

BACKGROUND OF THE INVENTION

1. Field of the Invention

This invention is related to a coaster and in particular to one which can give fascinating light through the bottom of a glass thereon.

2. Description of the Prior Art

It has been found that the conventional coaster is a small round mat placed under a glass, bottle, etc., to protect a table top or other surface from marks, drips or moisture. Nevertheless, such a coaster is too dull to attract the consumer's attention thereby making it unfit for practical use.

Therefore, it is an object of the present invention to provide an illuminating coaster which is exciting and appealing to the imagination.

SUMMARY OF THE INVENTION

This invention is related to an improved coaster placed under a glass.

It is the primary object of the present invention to provide an illuminating coaster which can give fascinating light through the bottom of a glass thereon.

It is another object of the present invention to provide an illuminating coaster which is interesting and appealing to the imagination.

It is still another object of the present invention to provide an illuminating coaster which is low in cost.

It is still another object of the present invention to provide an illuminating coaster which is facile to manufacture.

It is a further object of the present invention to provide an illuminating coaster which is fit for mass production.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
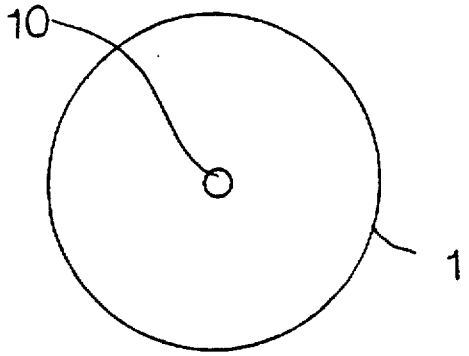
FIG. 1 is a top plan view of an illuminating coaster according to the present invention.
Figure 2:
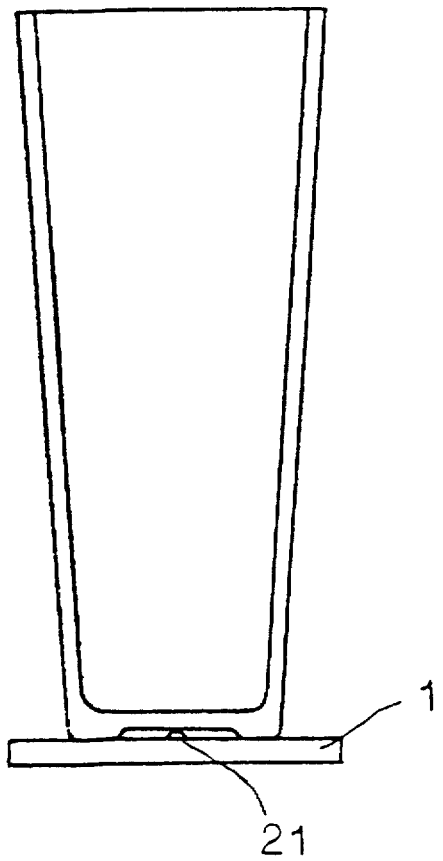
FIG. 2 illustrates the illuminating coaster placed under a glass.
Figure 3:
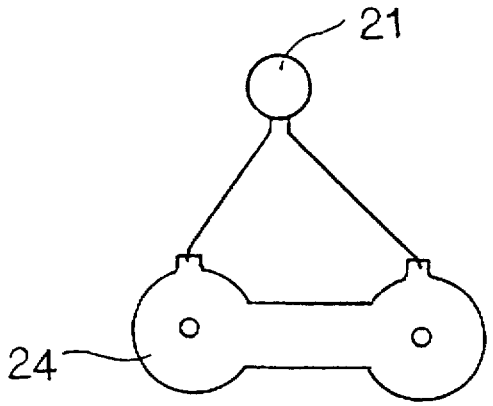
FIG. 3 is a top plan view of the second conducting member.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 1, 2, 3 and 5, the illuminating coaster according to the present invention comprises a circular body 1 which generally includes an upper member 11, an intermediate member 12 having an upper side fixedly connected with the bottom side of the upper member 11, and a lower member 13 having an upper side fixedly connected with the bottom side of the intermediate member 12.

Figure 4:
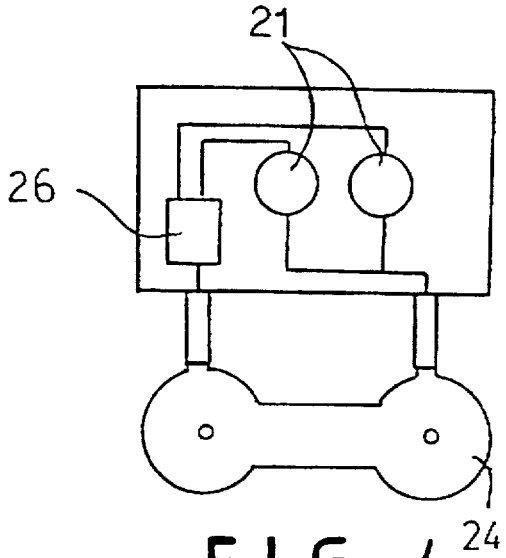
FIG. 4 illustrates a preferred modification of the second conducting member.
Figure 5:
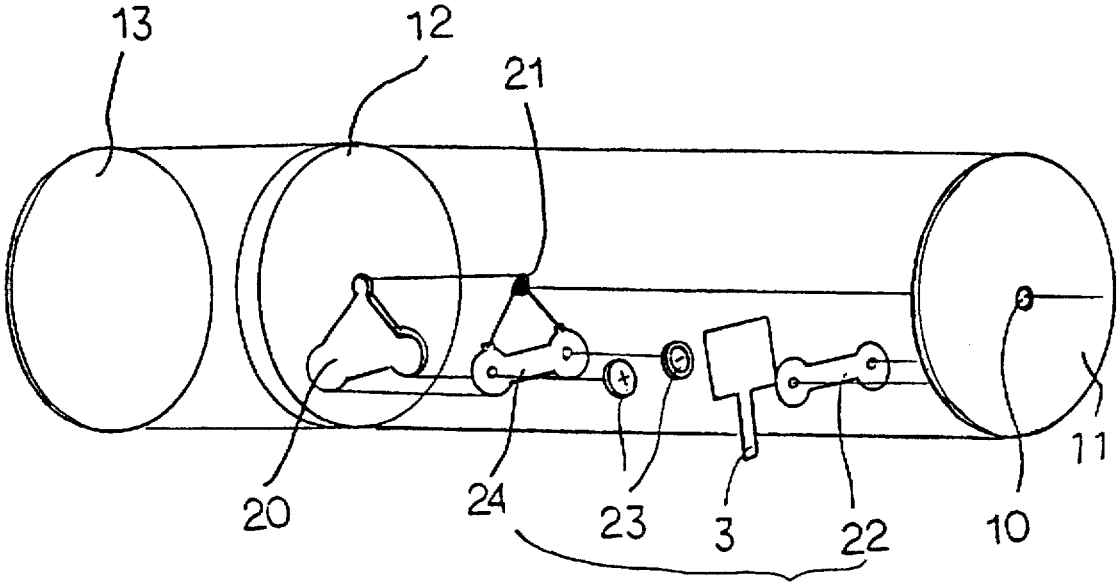
FIG. 5 is an exploded view of the illuminating coaster according to the present invention; coaster.

An illuminating assembly 2 is arranged between the upper member 11 and the intermediate member 12 and includes a first conducting member 22, a second conducting member 24, two batteries 23, and a separator 3. The first conducting member 22 which is used as an electrode is fixedly mounted on the inner side of the upper member 1. The second conducting member 24 is provided with a light-emitting diode 21 and used as another electrode. The two batteries 23 are disposed between the first and second conducting members 22 and 24. The separator 23 is made of insulating material and inserted between the first conducting member 22 and the batteries 23. The separator 23 is used for preventing the illuminating assembly 2 from being turned on during transportation. The illuminating assembly 2 may be provided with a printed circuit board 5 on which are mounted two light-emitting diodes 21 and a blinking circuit 26 (see FIGS. 4 and 8). The upper member 11 is formed with a hole 10 at its central portion for the passage of the light-emitting diode 21 or the like. The first conducting plate 22 which is used as an electrode is fixedly mounted on the inner side of the upper member 1.

The intermediate member 12 is fitted between the upper and lower members 11 and 13 and formed with an opening 20 for receiving and keeping the illuminating assembly 2 in a fixed position. Further, the intermediate member 12 is thicker than the upper and lower members 11 and 12 and resilient in property. The opening 20 of the intermediate member 12 has a depth which is slightly higher than the total thickness of the second conducting member 24 and the batteries 23 so that there is a small distance between the first conducting member 22 and the batteries 23. When a glass is put onto the illuminating coaster, the upper member 11 will be pressed downwardly to make the first conducting member 22 contact the batteries 23 thereby forming a closed circuit and therefore causing the light-emitting diode 21 to give light through the bottom of the glass.

Figure 6:
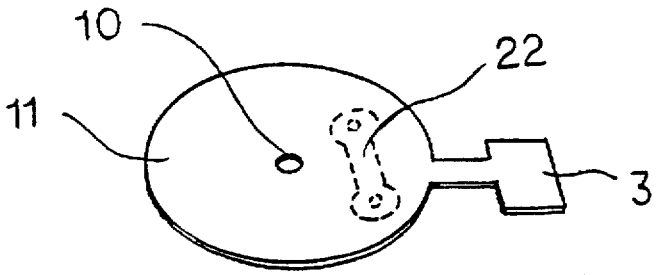
FIG. 6 is a perspective view of a preferred modification of the upper member.

FIG. 6 is a perspective view of a preferred modification of the upper member 11. As illustrated, the upper member 10 is formed with a center hole 10 and a separator 3 extending outwardly from the edge of the upper member 10. The first conducting member 22 is fastened on the upper member 11.

Figure 7:
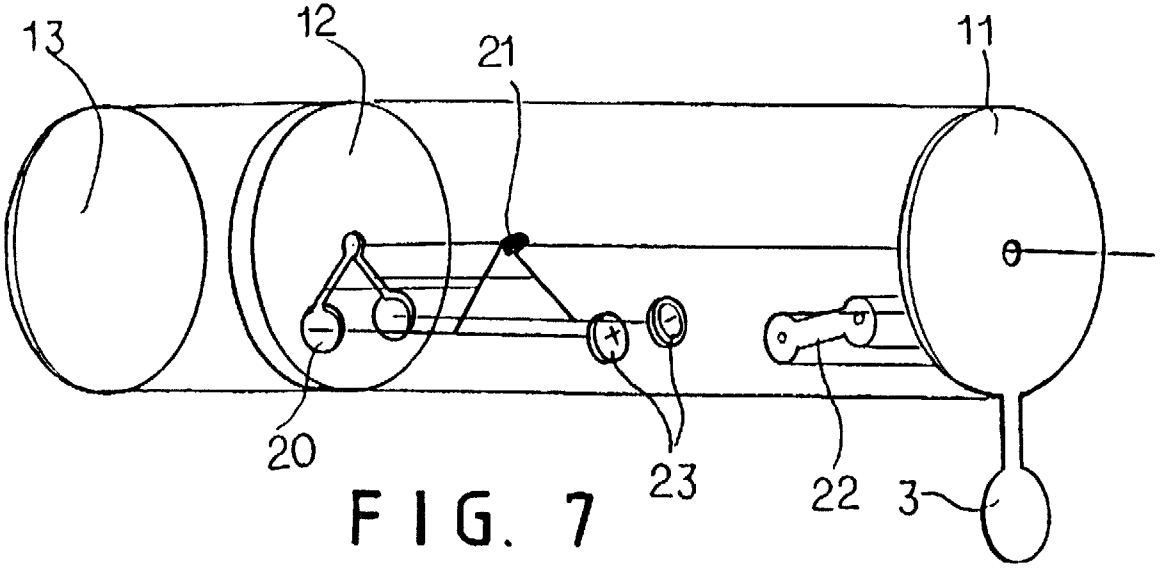
FIG. 7 illustrates a second preferred embodiment of the present invention.
Figure 8:
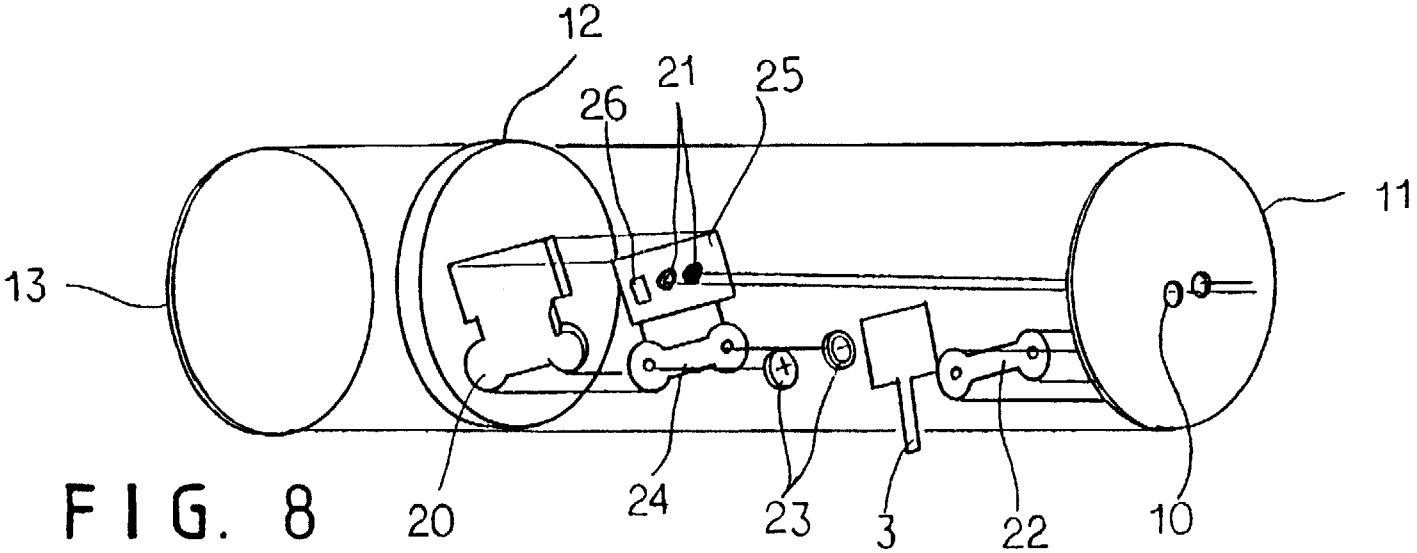
FIG. 8 illustrates a third preferred embodiment of the present invention.

FIG. 7 illustrates a second preferred embodiment of the present invention, wherein the illuminating coaster is provided with one light-emitting diode 21. FIG. 8 illustrates a third preferred embodiment of the present invention, wherein the illuminating coaster has two light-emitting diodes 21.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An illuminating coaster comprising:

an upper member;

an intermediate member;

a lower member;

an illuminating assembly arranged between said upper member and said intermediate member and including a first conducting member, a second conducting member, and batteries, said first conducting member being fixedly mounted on an inner side of said upper member, said first conducting member being fixedly mounted on an inner side of said upper member, said second conducting member being provided with a light-emitting diode, said batteries being disposed between said first and second conducting members;

said upper member formed with a hole for receiving said light-emitting diode;

said intermediate member fitted between said upper and lower members and formed with an opening adapted to receive and keep said illuminating assembly in a fixed position, said intermediate member being thicker than said upper and lower members and resilient in property, said opening of said intermediate member having a depth which is slightly higher than total thickness of said second conducting member and said batteries thereby forming a small distance between said first conducting member and said batteries.

2. The illuminating coaster as claimed in claim 1, further comprising a separator made of insulating material and fitted between said first conducting member and said batteries.

* * * * *